United States Patent [19]

Tottey

[11] 4,418,912

[45] Dec. 6, 1983

[54] AMUSEMENT DEVICE

[76] Inventor: Robert Tottey, Lansing North Apts., 211-D, Ithaca, N.Y. 14850

[21] Appl. No.: 407,932

[22] Filed: Aug. 13, 1982

[51] Int. Cl.[3] ..... A63F 9/00

[52] U.S. Cl. ..... 273/138 R; 273/1 L

[58] Field of Search ..... 273/138 R, 1 L

[56] References Cited

U.S. PATENT DOCUMENTS

| | | | |
|---|---|---|---|
| 1,273,746 | 7/1918 | Daniels | 273/138 R |
| 2,103,435 | 12/1937 | Pool | 273/138 R |
| 2,135,292 | 11/1938 | Pocell | 273/138 R |
| 2,191,150 | 2/1940 | Abell | 273/138 R |
| 2,239,420 | 4/1941 | Goldberg | 273/138 R |
| 2,345,781 | 4/1944 | Wiedemann | 273/138 R |
| 2,482,893 | 9/1949 | Bawden | 273/138 R |
| 2,719,041 | 9/1955 | Stefanelli et al. | 273/138 R |
| 4,177,986 | 12/1979 | Campbell | 273/1 L |

*Primary Examiner*—Paul E. Shapiro

*Attorney, Agent, or Firm*—Michael F. Brown

[57] ABSTRACT

A tavern game in the shape of an animal, in which a player attempts to place a coin in a target in the hollow, liquid-filled body of the animal. The liquid slows and deflects the coin. The coin traverses a delay mechanism in its path. In one embodiment an obstacle, in the form of an animal, is interposed between the delay mechanism outlet and the target to deflect the coin. Optionally, sounds and/or lights may be included to further attract players. The sounds and/or lights may be synchronized to the coin path to heighten suspense.

14 Claims, 3 Drawing Figures

AMUSEMENT DEVICE

FIELD OF THE INVENTION

The invention pertains to amusement devices of the coin-collecting type. More specifically, the invention pertains to amusement devices having the element of chance as their major object.

DESCRIPTION OF THE PRIOR ART

The invention is based upon the familiar fund-raising device, often used in stores to raise money for charities, in which a slot is punched in the top of a large jar (such as a pickle jar), the jar is filled with water, and a small target (such as a shot glass) is placed on the bottom of the jar. The object is to drop a coin in the slot and have it land in the target. The water in the jar serves to impart a random motion to the coin.

Wiedemann, U.S. Pat. No. 2,345,781, shows essentially the pickle jar/shot glass device, adding a suction cup on the bottom of the shot glass. Abel, No. 2,191,150, is much the same, with the target a pin upon which the coin must balance. Abel uses oil instead of water, to slow the coin further.

Other similar devices are Pool 2,103,435 and Pocell, 2,135,292, each with means to dump the target; Bawden, 2,482,893, having a movable target to catch the coin; and Stefanelli, 2,719,041, and Fekete, 3,901,512 with multiple targets serving in place of dice. Hutchison, 3,002,313, shows a bank with a coin-deflecting labyrinth to slow the coin fall, with attention-getting noise.

SUMMARY OF THE INVENTION

When the pickle-jar/shot glass game is used to raise money for charity, the players will deposit money out of desired to give to the charity. There is little need to attract attention to the game, nor to encourage repeated play. The game is, itself, not inherently attractive.

The current invention is intended for use as a tavern game, to be placed on a bar and to raise money for the owner. A reward may be offered, in the form of a free drink, to players who hit the target. In such an application the game must be attractive to players, present a challenge to their abilities, and encourage continued play. The game must be hard to win, lest too mny drinks be given away, yet appear possible to entice players to try one more time.

It is thus an object of the invention to provide a tavern game which is attractive to players and which will entice them to play the game repeatedly, once attracted.

One drawback of the earlier devices was that play was completed too quickly. It does not take long for a coin to fall to the bottom of a jar, even if water or oil filled. If a player is to be kept playing, he must feel he's getting his money's worth on each coin. The coin should be delayed (if possible out of sight of the player) before it drops into the liquid in the jar. Some form of audio of visual feedback, in the form of electronic tones and/or a light, may optionally serve to heighten the suspense as the player waits for his coin to appear.

It is a further object of the invention to provide a tavern game of the type described in which the play is prolonged by delaying the entry of the coin into the liquid.

I have found that an animal shape is an especially attractive form for a game of this type. The head or neck of the animal provides a convenient hiding place for the play-prolonging mechanism as well as an attention-getting or feedback mechanism such as a speaker or light. The body is formed of clear material, such as glass, to allow the player to see the coin and target. Optionally, a further coin-deflecting element appropriate to the type of animal may be placed in the water to make the play more interesting.

It is, therefore, an object of the invention to provide a liquid-filled type of coin-collector game in the shape of an animal, in which the play is prolonged through delaying entry of the coin into the liquid, and in which the animal provides an attractive means for at one time hiding the mechanism and calling attention to the game.

DESCRIPTION OF THE PREFERRED EMBODIMENT

Figure 1:
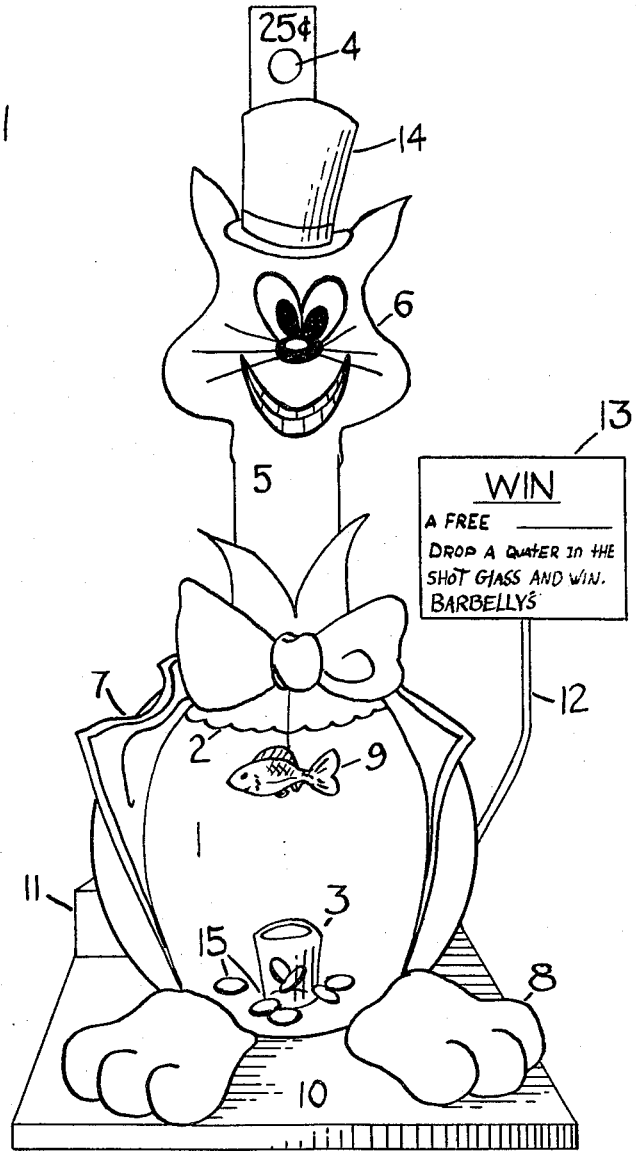
FIG. 1 shows the invention, in the form of a cat

FIG. 1 shows the preferred embodiment of the invention, in the form of a cat. The animal selected for the game may vary, depending on the theme of the establishment, as shown by the frog in FIG. 3. The basic arrangement, as described herein, will be the same regardless of which animal is chosen.

The body of the animal (1) is formed of clear material, preferably glass. A near-spherical body with a flat base is preferred, as it allows maximum movement of the coin, as well as providing a humorous form to the animal. The prototype was made from a two-liter laboratory flask having a round body (1) and long narrow neck (5), which was ideal for this application. It will be recognized, however, that many other materials and shapes would also be suitable. It is only required that the body be liquid-tight, have at least one clear side, and be sufficiently large to allow the coin some freedom of movement.

The body (1) is filled with a liquid (2), preferably water, to impart a random motion to the coins (15). A more viscous liquid, such as clear oil or syrup would prolong the play by slowing the coin (15) further, at a price in ease of use.

Centered in the bottom of the body is the target (3), here shown as a shot glass, a form which is particularly appropriate to a bar setting. The target (3) is preferably small enough to occupy only a fraction of the body (1) to make play difficult, but large enough to accept a number of coins (15). If desired, the target could be a raised platform only slightly larger than a coin, upon which the coin must land.

Figure 3:
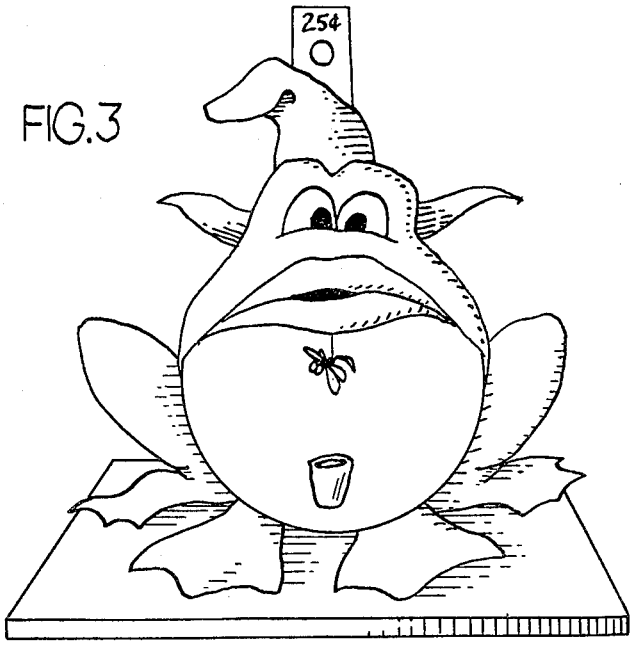
FIG. 3 is another embodiment of the invention, in the form of a frog.

The basic game body (1) and neck (15) are covered with a cloth structure defining the animal. In FIG. 1, the cat is formed of feet (8), a jacket (7), head (67, and top hat (14). FIG. 3 shows how a slightly different structure could turn a similar container into a frog.

On top of the animal's head (6) or hat (14) is a coin slot (4) adapted to accept whatever denomination of coin, or other disk such as a token or poker chip, is being used. The slot (4) communicates with a passageway which leads the coin (15) through the neck (5) and into the water (2).

Figure 2:
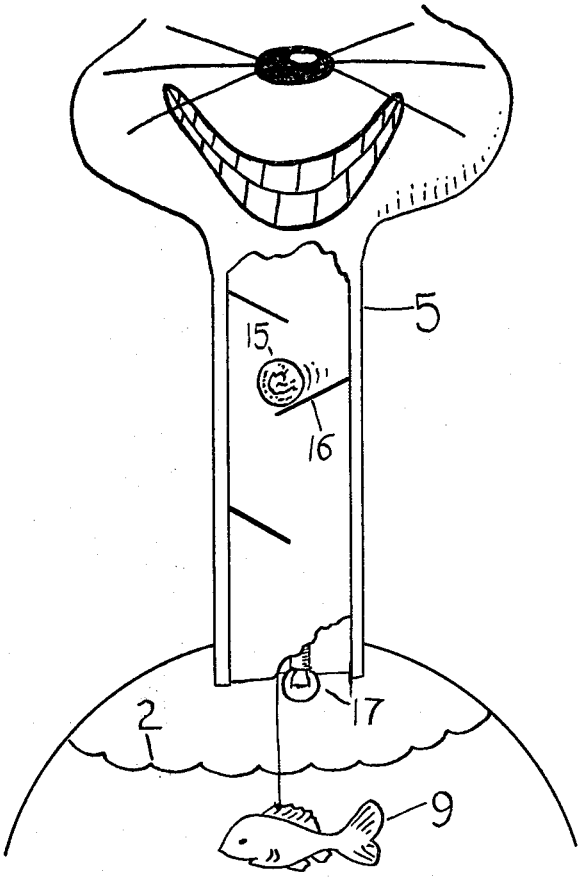
FIG. 2 is a view showing details of the neck of the cat

FIG. 2 shows a detail, with the body and neck covers cut away, of the neck structure of the cat in FIG. 1. The coin (15) drops past a labyrinth of barriers (16) which lengthens the path traversed, and thus slows the coin. Since the clothing (7) covers this portion of the game, the player is kept in suspense as to when the coin will drop. Alternatively, another design of play-slowing mechanism could be secreted in the neck, such as a timed gate or see-saw, without departing from the teachings of the invention.

The animal may be mounted upon a base (10), if desired, with a sign (13) mounted on a stalk (12) explaining what prize may be won, or whatever other message is desired.

In the preferred embodiment, a coin-deflecting element (9) is placed in the body (1) of the animal to further complicate the play. This element will preferably be chosen to be another animal figure appropriate to the main animal, such as a fish (9) or canary for a cat, or a fly for a frog (FIG. 3), although an abstract figure or plant could be used for the same effect. The coin deflecting element (9) could be suspended from above, as shown, or from below, attached by a stalk to the target (3). As another alternative, the element could be free-floating, or perhaps a real fish.

To make play more attractive, the preferred embodiment of the invention has a light (17) mounted in the neck to illuminate the target (3) and deflector (fish) (9). The light (7) may be on continuously or activated by the insertion of the coin.

As an additional attraction, the game will preferably emit sounds in response to the insertion of a coin, to heighten the suspense as the coin drops and to attract other players. The sound could be beeps synchronized to the bouncing of the coin (15) against the barriers (16) in the labyrinth, or increasing in tone or repetition rate as the coin drops. A special sound could be activated when a coin hits the target. A "talking chip" voice synthesizer IC such as that produced by Texas Instruments could be used to give the animal a vocabulary of words or sounds to be produced in response to a coin, or to invite players to participate. The electronic controls may be concealed in the actual structure of the animal, for example in the hat (14), head (6), or neck (5), or be placed in a separate box (11) outside the animal.

It will be understood that the invention, although described primarily as a tavern game, may be used as a game or bank or fund-raising device in any environment.

Accordingly, it is to be understood that the embodiments of the invention herein described are merely illustrative of the application of the principles of the invention. Reference herein to details of the illustrated embodiments are not intended to limit the scope of the claims which themselves recite those features regarded as essential to the invention.

I claim:

1. A coin-collecting amusement device in the form of an animal, comprising:

a. a hollow body capable of being substantially filled with a liquid having a top, a flat base, an opening located above the flat base, and at least one transparent side portion;

b. a target adapted to receiving a coin located inside the hollow body, on the flat base and disposed substantially under the opening;

c. coin path means for guiding a coin into the body having an upper slot end adapted to receiving a coin and a lower end communicating with the opening in the body, whereby the coin is guided from the slot into the body;

d. delay means in the coin path means for slowing the passage of the coin through the coin path means;

e. covering means for simulating an animal, substantially hiding the body, coin path means and delay means, whereby the amusement device is caused to appear in the shape of an animal;

f. said covering means revealing at least enough to the transparent side portion of the body to allow the target to be seen from outside the body.

2. The amustment device of claim 1 in which the body is filled with a liquid, whereby the coins passing into the body are slowed and deflected.

3. The amusement device of claim 2 in which the liquid is water.

4. The amustment device of claim 1 further comprising obstacle means for deflecting coins located in the body between the opening and the target.

5. The amusement device of claim 4 in which the obstacle means is the shape of an animal.

6. The amusement device of claim 5 in which the obstacle means is in the form of a fish.

7. The amusement device of claim 1 in which the delay means comprises a labyrinth comprising a plurality of barriers in the coin path, whereby the coin is constrained to follow a longer path than it would without the delay means.

8. The amusement device of claim 1 further comprising audiable means for attracting attention to the game.

9. The amusement device of claim 8 in which the audiable means comprises a plurality of electronic beeps having a given frequency and repetition rate.

10. The amusement device of claim 9 in which the frequency and/or repetition rate changes over time.

11. The amusement device of claim 10 in which the change is in response to the passage of a coin through the coin path means.

12. The amusement device of claim 1 further comprising light means for illuminating the target.

13. The amusement device of claim 12 in which the light means changes in intensity in response to the passage of a coin through the coin path means.

14. The amusement device of claim 1 further comprising alarm means for indicating the presence of a coin in the target.

* * * * *